US012557910B2

(12) United States Patent
Su

(10) Patent No.: US 12,557,910 B2
(45) Date of Patent: Feb. 24, 2026

(54) FLEXIBLE SUPPORT DEVICE FOR CHAIR BACK TILTING

(71) Applicant: Dongguan Kentec Office Seating CO., LTD., Dongguan (CN)

(72) Inventor: Chih-Cheng Su, Taipei (TW)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 191 days.

(21) Appl. No.: 18/603,193

(22) Filed: Mar. 12, 2024

(65) Prior Publication Data

US 2024/0315451 A1 Sep. 26, 2024

(30) Foreign Application Priority Data

Mar. 21, 2023 (CN) ..... 202320574165.4

(51) Int. Cl.
*A47C 1/032* (2006.01)

(52) U.S. Cl.
CPC ..... *A47C 1/03272* (2013.01)

(58) Field of Classification Search
CPC ..... A47C 1/03266; A47C 1/03272
See application file for complete search history.

(56) References Cited

U.S. PATENT DOCUMENTS

| | | | | |
|---|---|---|---|---|
| 9,414,680 | B2 * | 8/2016 | Su | A47C 1/03272 |
| 9,414,681 | B2 | 8/2016 | Bellilngar et al. | |
| 9,549,614 | B2 * | 1/2017 | Bock | A47C 1/03277 |
| 10,028,586 | B2 * | 7/2018 | Schneider | A47C 1/03238 |
| 10,376,066 | B2 | 8/2019 | Su | |
| 10,842,272 | B2 * | 11/2020 | Costaglia | A47C 1/03255 |
| 11,160,377 | B2 * | 11/2021 | Bock | A47C 1/03277 |
| 2004/0140702 | A1 * | 7/2004 | Daeschle | A47C 1/03266 297/300.5 |
| 2007/0290537 | A1 * | 12/2007 | Lin | A47C 1/03272 297/300.2 |

FOREIGN PATENT DOCUMENTS

| | | | | |
|---|---|---|---|---|
| CN | 218571823 U * | 3/2023 | | |
| DE | 102008037857 A1 * | 2/2010 | | A47C 1/03272 |
| WO | WO-2009090770 A1 * | 7/2009 | | A47C 1/03266 |
| WO | WO-2023047633 A1 * | 3/2023 | | A47C 1/03272 |

* cited by examiner

*Primary Examiner* — Joshua D Huson
*Assistant Examiner* — Anna L. Gordon
(74) *Attorney, Agent, or Firm* — LANWAY IPR SERVICES; Chun-Ming Shih

(57) ABSTRACT

A flexible support device for chair back tilting contains: a supporting frame, a seat mounting, and a base. The supporting frame includes a back portion, two peripheral extensions, two rotatable edges, two first coupling orifices, and two second coupling orifices. The seat mounting includes a first fixing portion, a second fixing portion, two connecting fences, two rotatable locating portions, two defining orifices, two joining elements, two slide orifices, and a drive protrusion. The base includes two locating fringes with two first positioning orifices, two second positioning orifices, a holder connected with a first end of a spring, and a second end of the spring is connected with a flexible sheet. The flexible sheet has two peripheral sections. The base further includes two connection segments, and the two connection segments have two openings. Two connectors are configured to accommodate the flexible sheet and have two pegs.

6 Claims, 10 Drawing Sheets

FLEXIBLE SUPPORT DEVICE FOR CHAIR BACK TILTING

TECHNICAL FIELD

The present invention relates to a chair, and more particularly to a flexible support device for a chair back tilting.

BACKGROUND

A conventional office chair has a back which is adjustably tilted by using at least one spring defined between the back and a seat. However, the at least one spring will cause a fatigue after a period of using time. A conventional flexible support device for a chair back tilting are disclose in U.S. Pat. Nos. 9,414,681 and 10,376,066, but the chair back is tilted by using at least one spring made of metal. Also, at least one pull stud is configured to pull the at least one spring and is made of metal, thus causing noises, heavy weight, high fabrication cost, and using fatigue.

The present invention has arisen to mitigate and/or obviate the afore-described disadvantages.

SUMMARY

The primary aspect of the present invention is to provide a flexible support device for a chair back tilting which is capable of overcoming a fatigue and noises of the spring.

Another aspect of the present invention is to provide a flexible support device for a chair back tilting which contains the flexible sheet to obtain light weight and low fabrication cost To obtain above-mentioned aspect, a flexible support device for a chair back tilting provided by the present invention contains: a supporting frame, a seat mounting, and a base.

The supporting frame includes a back portion formed on a rear end of the supporting frame, two peripheral extensions extending from two sides of a bottom of the back portion, two rotatable tabs oppositely extending from the two peripheral extensions, two through orifices defined on the two rotatable tabs, two rotatable edges formed on two distal ends of the two peripheral extensions, two first coupling orifices defined on the two rotatable edges, and two second coupling orifices formed proximate to the two first coupling orifices.

The seat mounting includes a first fixing portion and a second fixing portion opposite to the first fixing portion, two connecting fences connected with two sides of the first fixing portion and the second fixing portion, two rotatable locating portions formed on the two sides of the second fixing portion, two defining orifices defined on the two rotatable locating portions and corresponding to the two through orifices of the supporting frame, two joining elements configured to connect with the two through orifices of the supporting frame via the two defining orifices of the seat mounting, two slide orifices defined on two inner walls of the two connecting fences adjacent to the first fixing portion, and a drive protrusion extending to the second fixing portion from a center of an inner wall of the first fixing portion.

The base includes two locating fringes with two first positioning orifices corresponding to the two first coupling orifices of the supporting frame, two second positioning orifices corresponding to the two second coupling orifices of the supporting frame, such that the two first coupling orifices and the two second coupling orifices of the supporting frame are connected with the two first positioning orifices and the two second positioning orifices by using two first screw bolts and two second screw bolts; the base further includes a holder extending from a center of a front end thereof and connected with a first end of a spring, and a second end of the spring being connected with a center of a first side of a flexible sheet.

The flexible sheet has two peripheral sections formed on two sides thereof and accommodated in two receiving grooves of two connectors, the base further includes two connection segments corresponding to the two connectors, wherein the two connection segments have two openings, and the two connectors have two pegs extending therefrom and corresponding to the two openings so that the two pegs of the two connectors are connected with the two openings of the two connection segments, and the two peripheral sections of the flexible sheet are fixed on the two connection segments, thus fixing the flexible sheet.

The two connection segments have two shafts extending from two outer walls thereof and slidably received in the two slide orifices of the seat mounting, and a center of a second side of the flexible sheet opposite to the spring is biased against the drive protrusion of the seat mounting.

DETAILED DESCRIPTION

Figure 1:
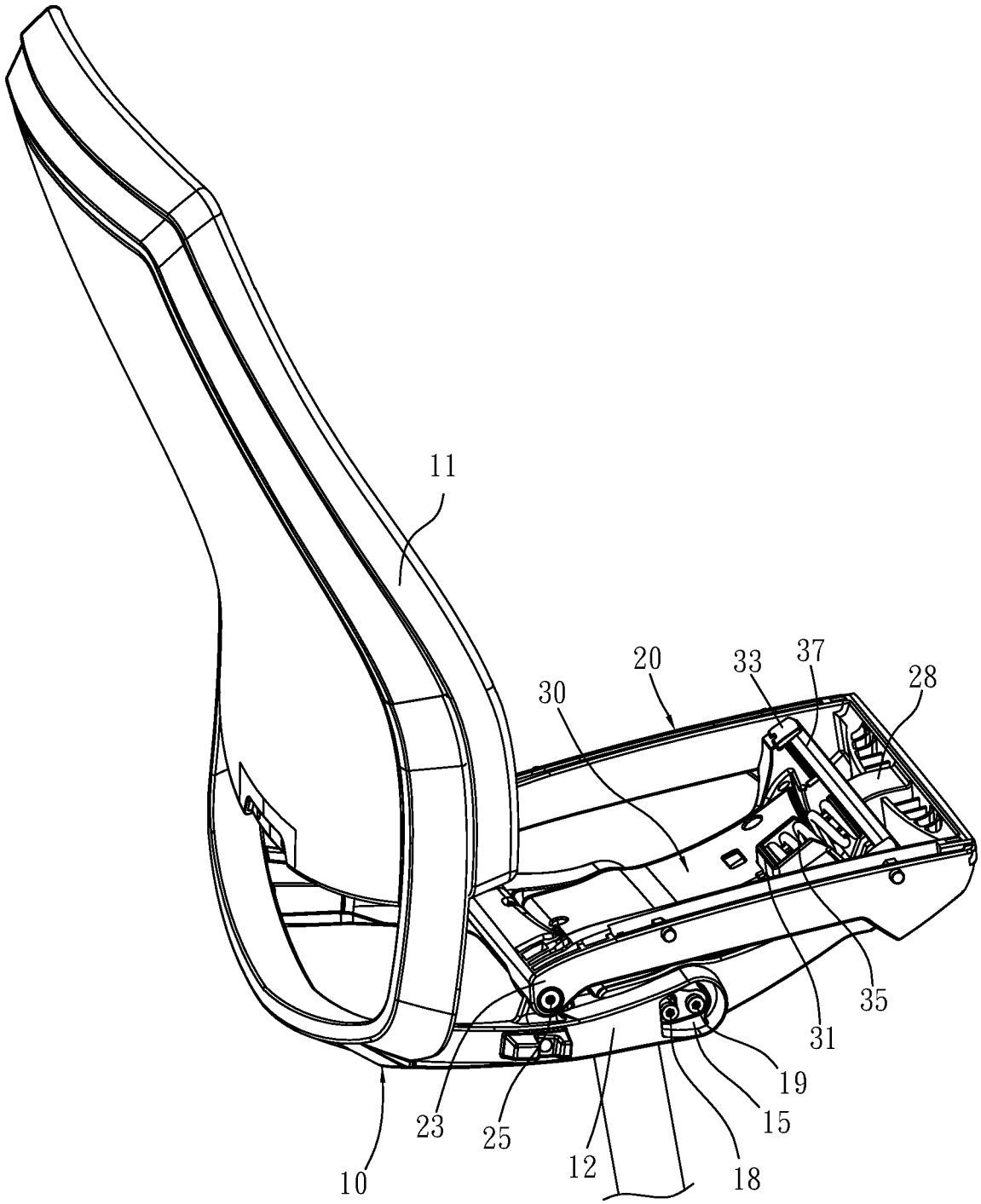
FIG. 1 is a perspective view showing the assembly of a flexible support device for a chair back tilting according to a preferred embodiment of the present invention.
Figure 2:
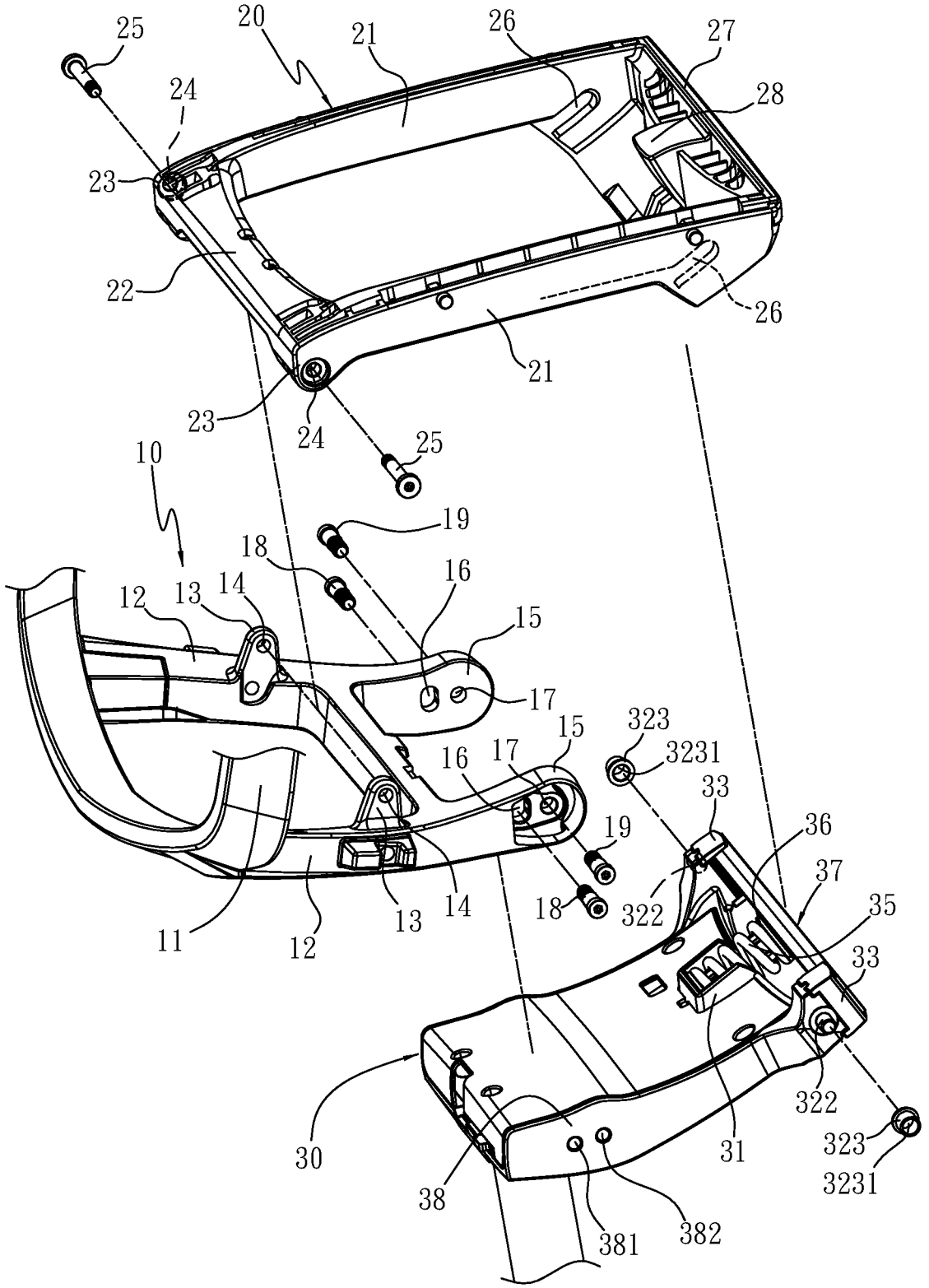
FIG. 2 is a perspective view showing the exploded components of the flexible support device for the chair back tilting according to the preferred embodiment of the present invention.
Figure 3A:
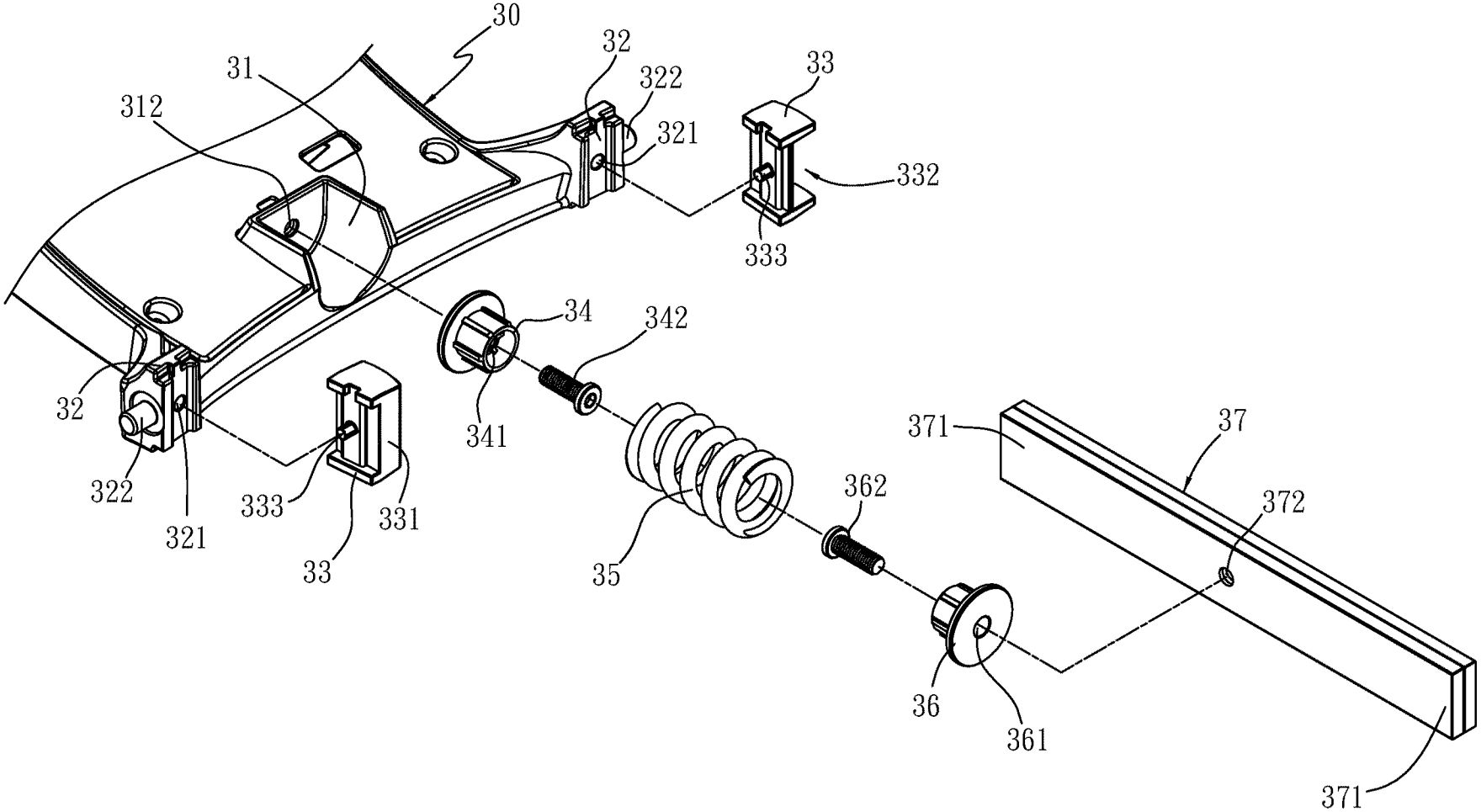
FIG. 3A is a perspective view showing the exploded components of a part of the flexible support device for the chair back tilting according to the preferred embodiment of the present invention.
Figure 3B:
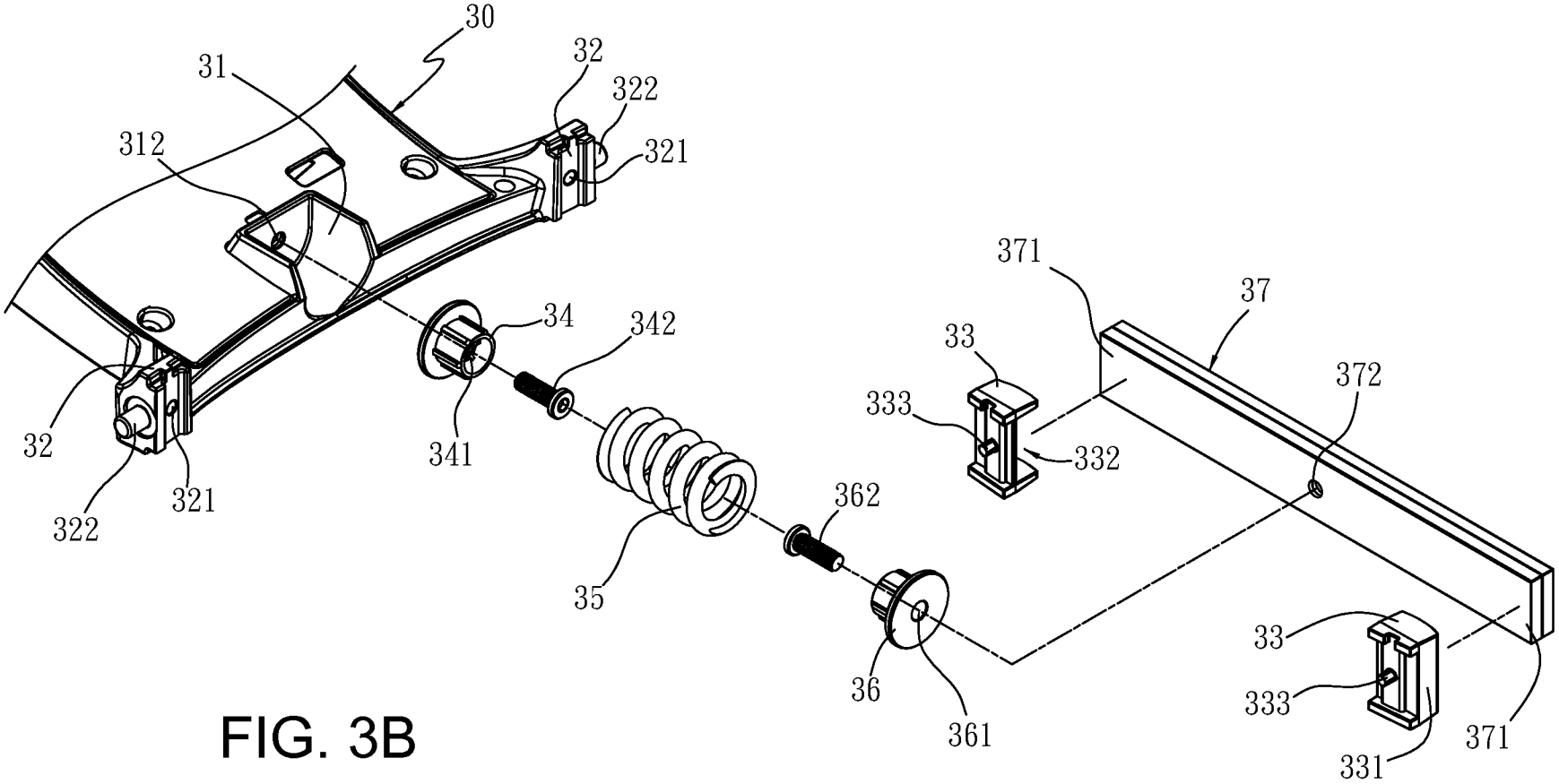
FIG. 3B is another perspective view showing the exploded components of a part of the flexible support device for the chair back tilting according to the preferred embodiment of the present invention.

Referring to FIGS. 1, 2, 3A, 3B and 4 to 9, a flexible support device for chair back tilting according to a preferred embodiment of the present invention comprises: a supporting frame 10, a seat mounting 20, and a base 30.

The supporting frame 10 includes a back portion 11 formed on a rear end thereof, two peripheral extensions 12 extending from two sides of a bottom of the back portion 11, two rotatable tabs 13 oppositely extending from the two peripheral extensions 12, two through orifices 14 defined on the two rotatable tabs 13, two rotatable edges 15 formed on two distal ends of the two peripheral extensions 12, two first coupling orifices 17 defined on the two rotatable edges 15, and two second coupling orifices 16 formed proximate to the two first coupling orifices 17.

The seat mounting 20 includes a first fixing portion 27 and a second fixing portion 22 opposite to the first fixing portion 27, two connecting fences 21 connected with two sides of the first fixing portion 27 and the second fixing portion 22, two rotatable locating portions 23 formed on the two sides of the second fixing portion 22, two defining orifices 24 defined on the two rotatable locating portions 23 and corresponding to the two through orifices 14 of the supporting frame 10, two joining elements 25 configured to connect with the two through orifices 14 of the supporting frame 10 via the two defining orifices 24 of the seat mounting 20, two slide orifices 26 defined on two inner walls of the two connecting fences 21 adjacent to the first fixing portion 27, and a drive protrusion 28 extending to the second fixing portion 22 from a center of an inner wall of the first fixing portion 27.

The base 30 includes two locating fringes 38 with two first positioning orifices 382 corresponding to the two first coupling orifices 17 of the supporting frame 10, two second positioning orifices 381 corresponding to the two second coupling orifices 16 of the supporting frame 10, such that the two first coupling orifices 17 and the two second coupling orifices 18 of the supporting frame 10 are connected with the two first positioning orifices 382 and the two second positioning orifices 381 by using two first screw bolts 19 and two second screw bolts 18.

The base 30 further includes a holder 31 extending from a center of a front end thereof and connected with a first end of a spring 35, and a second end of the spring 35 is connected with a center of a first side of a flexible sheet 37.

The first end of the spring 35 is fitted with a first fitting sleeve 34, and the second end of the spring 35 is fitted with a second fitting sleeve 36, wherein the first fitting sleeve 34 has a first passing orifice 341 defined on a center thereof, and the holder 31 has a second passing orifice 312 corresponding to the first passing orifice 341, such that the second passing orifice 312 and the first passing orifice 341 are connected with a first threaded post 341 to support the first end of the spring 35 to connect with the holder 31 of the base 30. The second fitting sleeve 36 has a third passing orifice 361 defined on a center thereof, and the flexible sheet 37 has a screw portion 372 corresponding to the third passing orifice 361, such that the screw portion 372 and the second passing orifice 361 are connected with a second threaded post 362 to support the second end of the spring 35 to connect with the center of the flexible sheet 37.

The flexible sheet 37 has two peripheral sections 371 formed on two sides thereof and accommodated in two receiving grooves 332 of two connectors 33, the base 30 further includes two connection segments 32 corresponding to the two connectors 33, wherein the two connection segments 32 have two openings 321, and the two connectors 33 have two pegs 333 extending therefrom and corresponding to the two openings 321 so that the two pegs 333 of the two connectors 33 are connected with the two openings 321 of the two connection segments 32, and the two peripheral sections 371 of the flexible sheet 37 are fixed on the two connection segments 32, thus fixing the flexible sheet 37. The two connection segments 32 have two shafts 322 extending from two outer walls thereof and slidably received in the two slide orifices 26 of the seat mounting 20. A center of a second side of the flexible sheet 37 opposite to the spring 35 is biased against the drive protrusion 28 of the seat mounting 20.

Preferably, the flexible sheet 37 is made of plastic or carbon fiber to reduce a fabrication cost.

Preferably, two connectors 33 have two stop fringes 331 extending from two sides thereof to avoid a removal of the flexible sheet 40.

Preferably, the two second coupling orifices 16 of the supporting frame 10 are elongated to provide a margin of the chair back tilting.

Preferably, the two shafts 322 of the base 30 have two sheathes 323 with two apertures 3231 fitted on the two shafts 322 so as to reduce a friction of the two shafts 322 of the base 30 or the two slide orifices 26 of the seat mounting 20, when the two shafts 322 contact with the two slide orifices 26.

Figure 4:
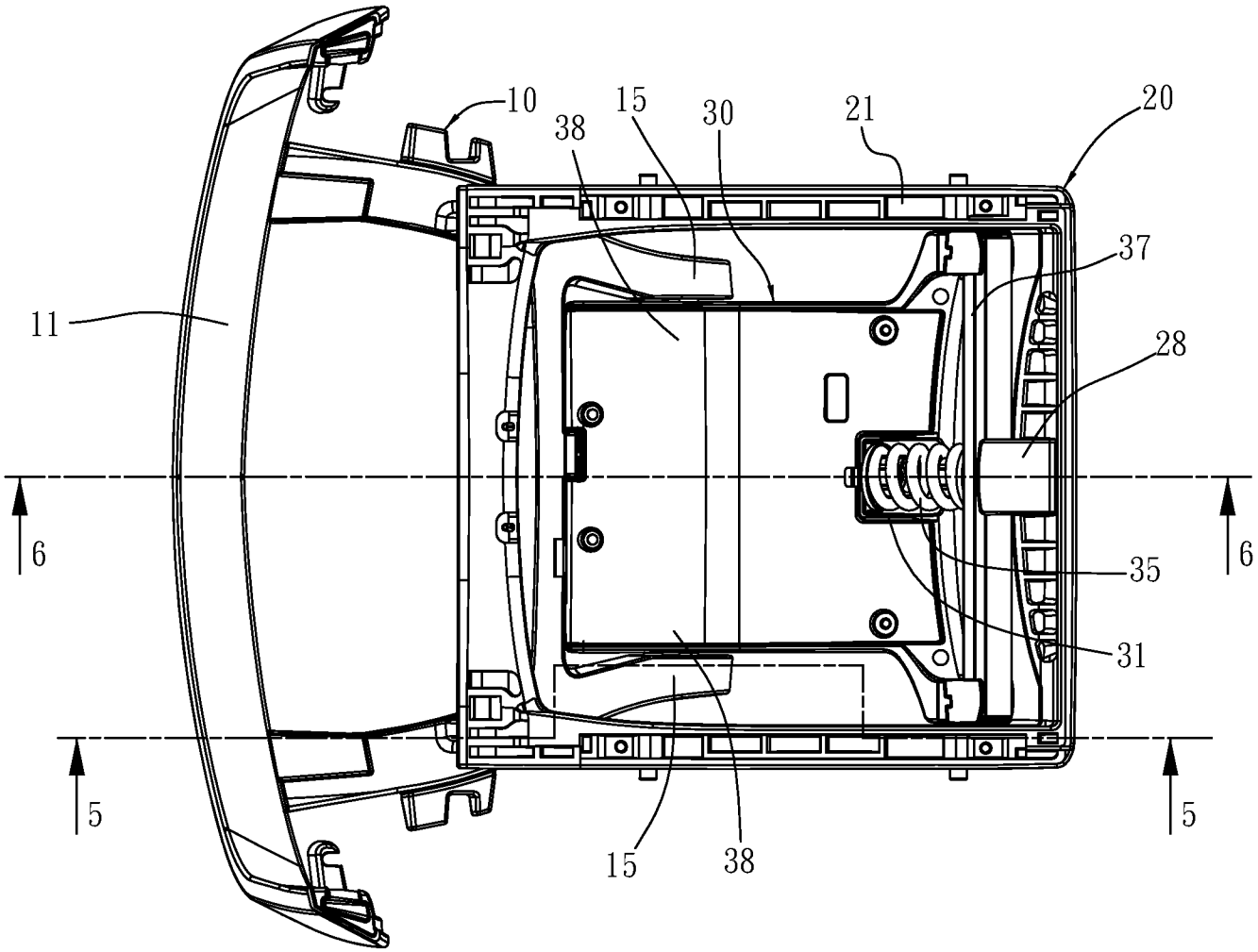
FIG. 4 is a top plan view showing the operation of the flexible support device for the chair back tilting according to the preferred embodiment of the present invention.
Figure 5:
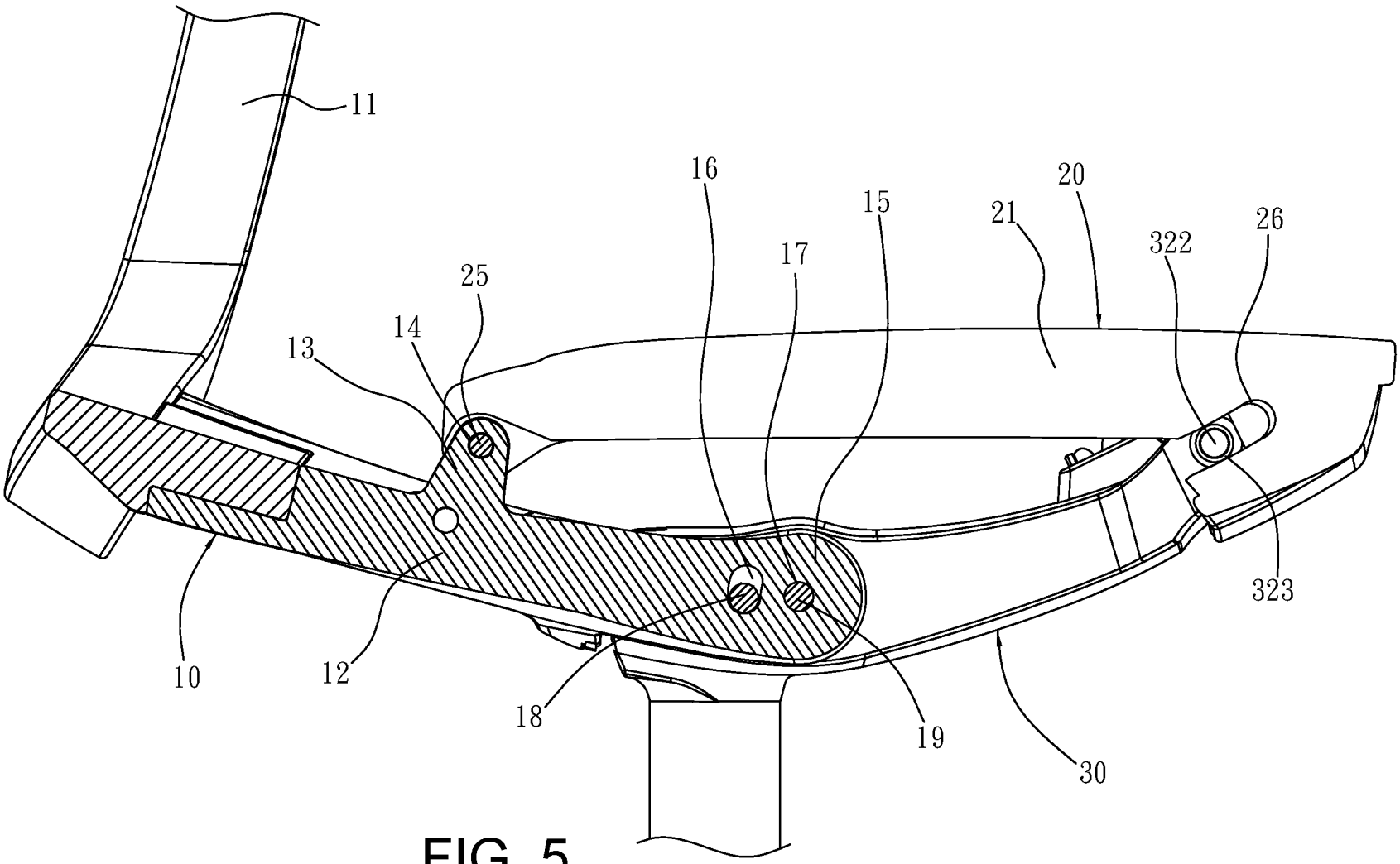
FIG. 5 is a cross sectional view taken along the line 5-5 of FIG. 4.
Figure 6:
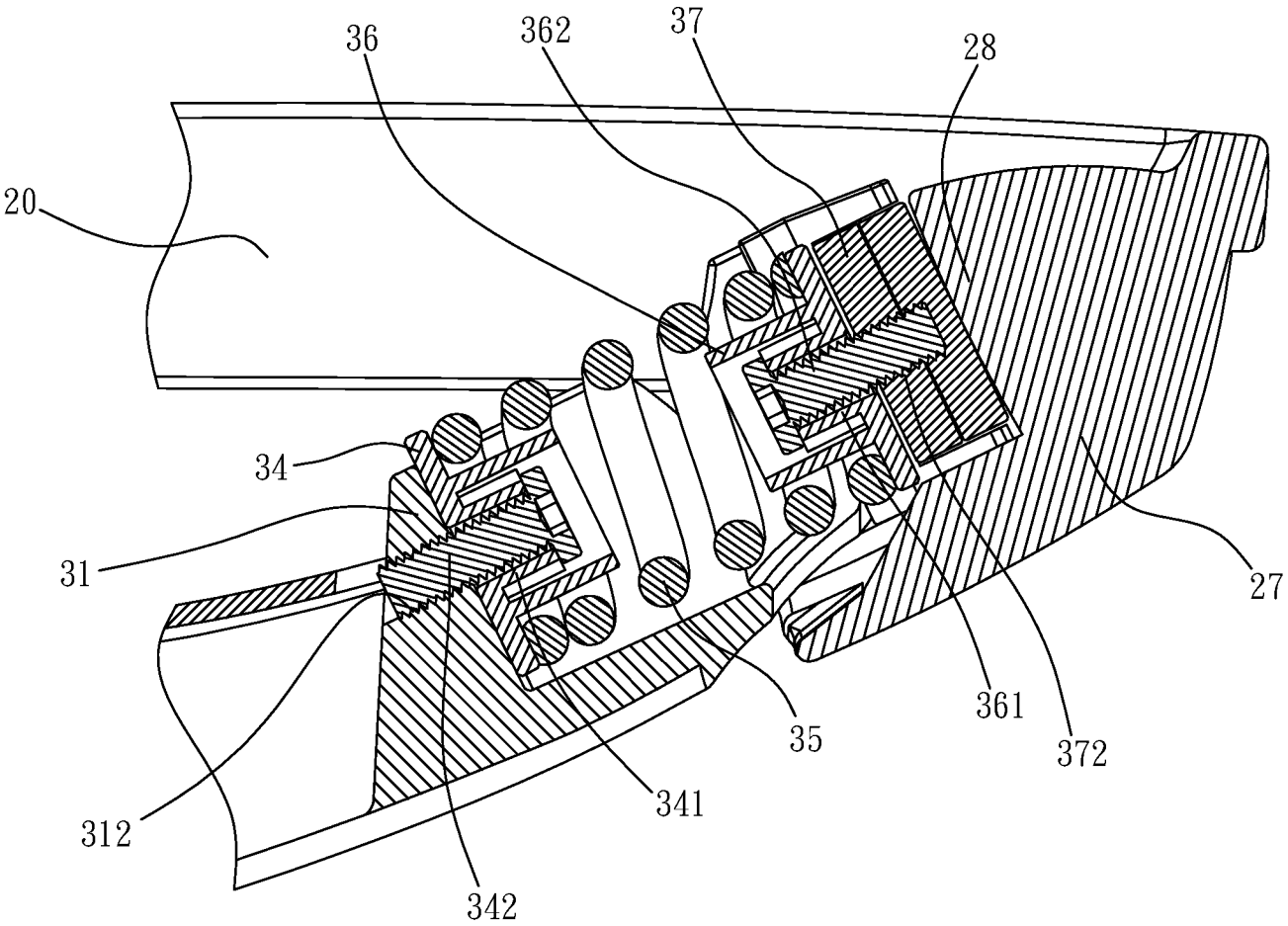
FIG. 6 is a cross sectional view taken along the line 6-6 of FIG. 4.

Referring to FIGS. 4-6, after the back portion 11 is not forced, the supporting frame 10 does not drive the seating mounting 20 to slide on the base 30, and the drive protrusion 28 of the seat mounting 20 does not press the flexible sheet 37 to deform.

Figure 7:
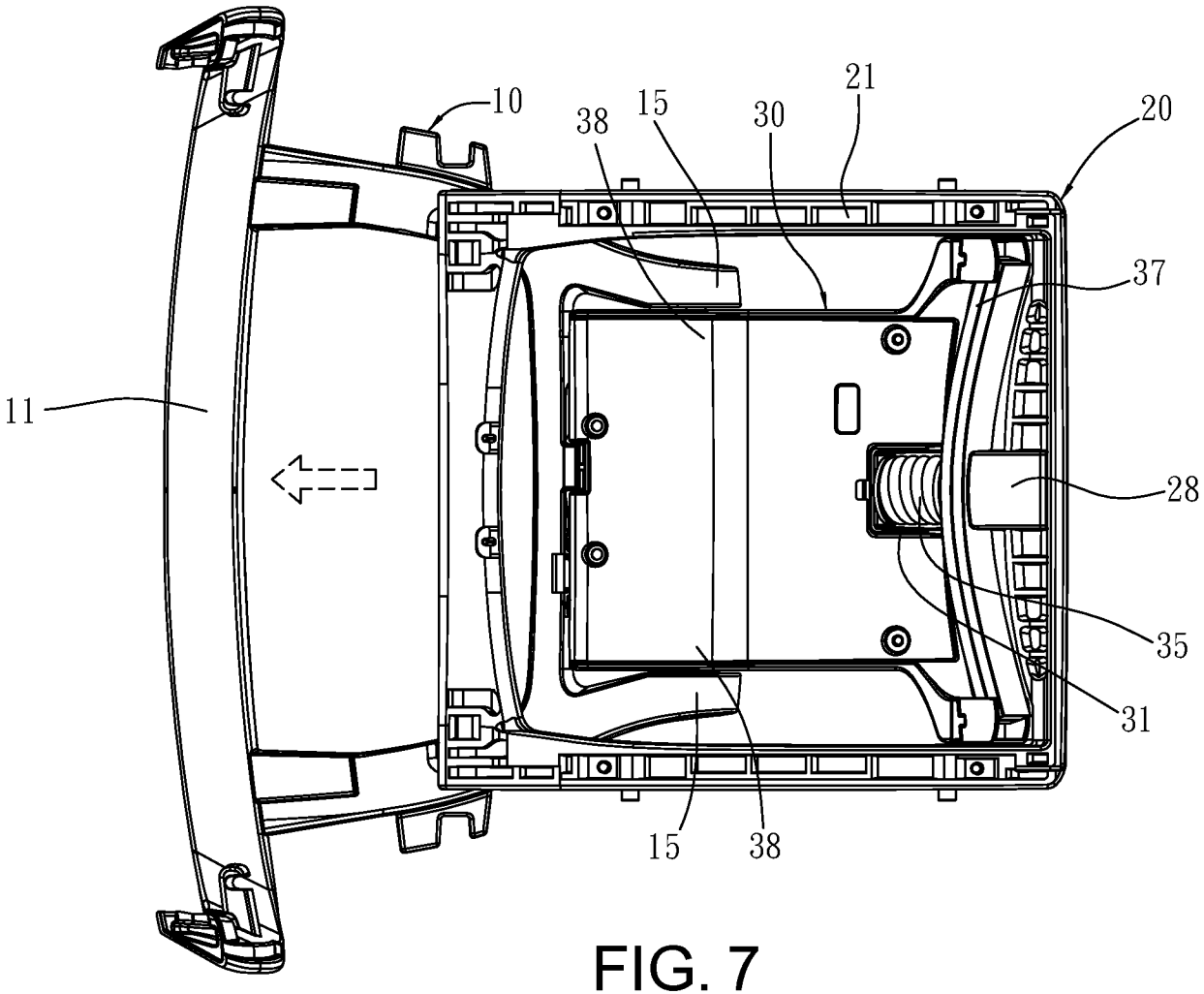
FIG. 7 is another top plan view showing the operation of the flexible support device for the chair back tilting according to the preferred embodiment of the present invention.
Figure 8:
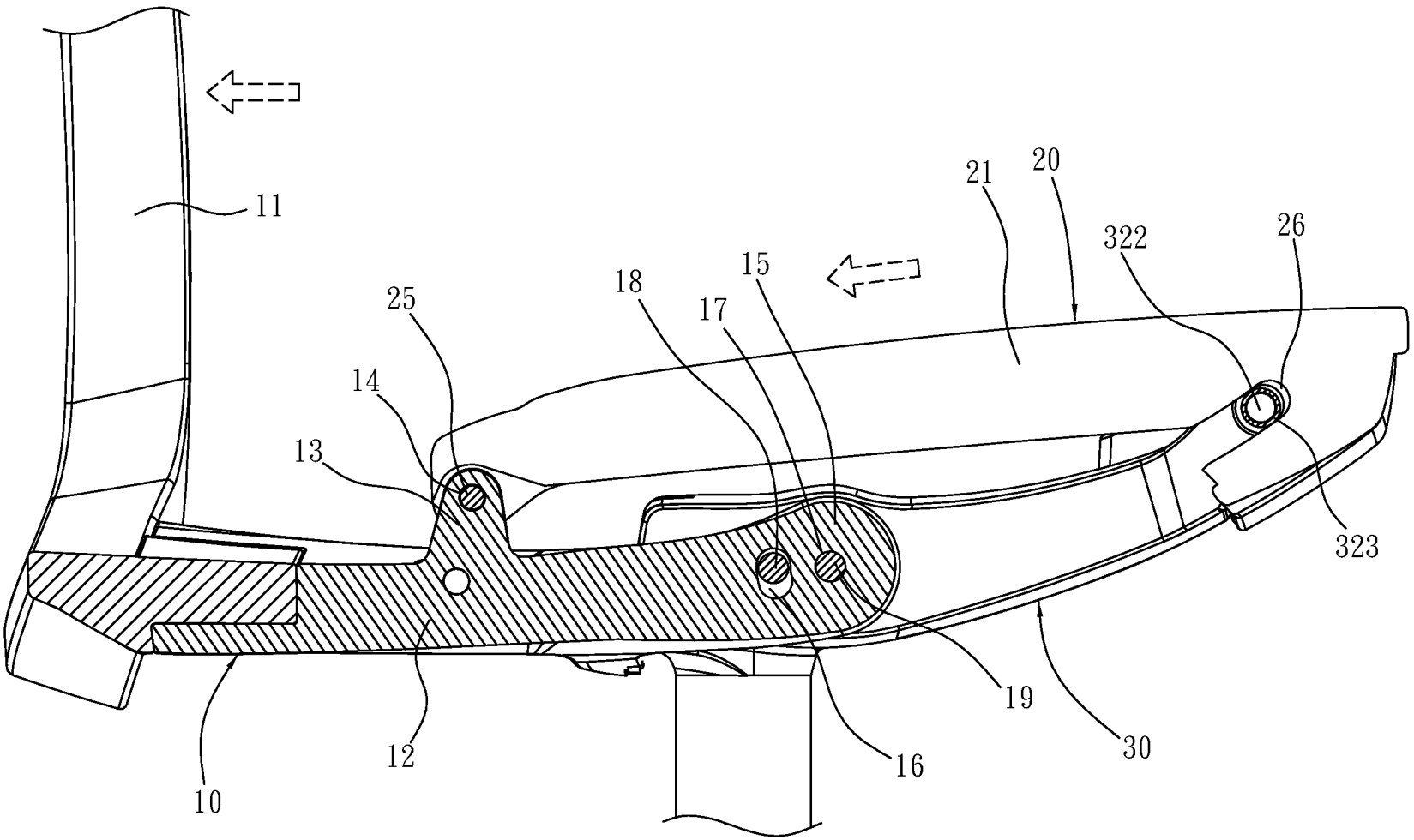
FIG. 8 is a cross sectional view showing the operation of the flexible support device for the chair back tilting according to the preferred embodiment of the present invention.
Figure 9:
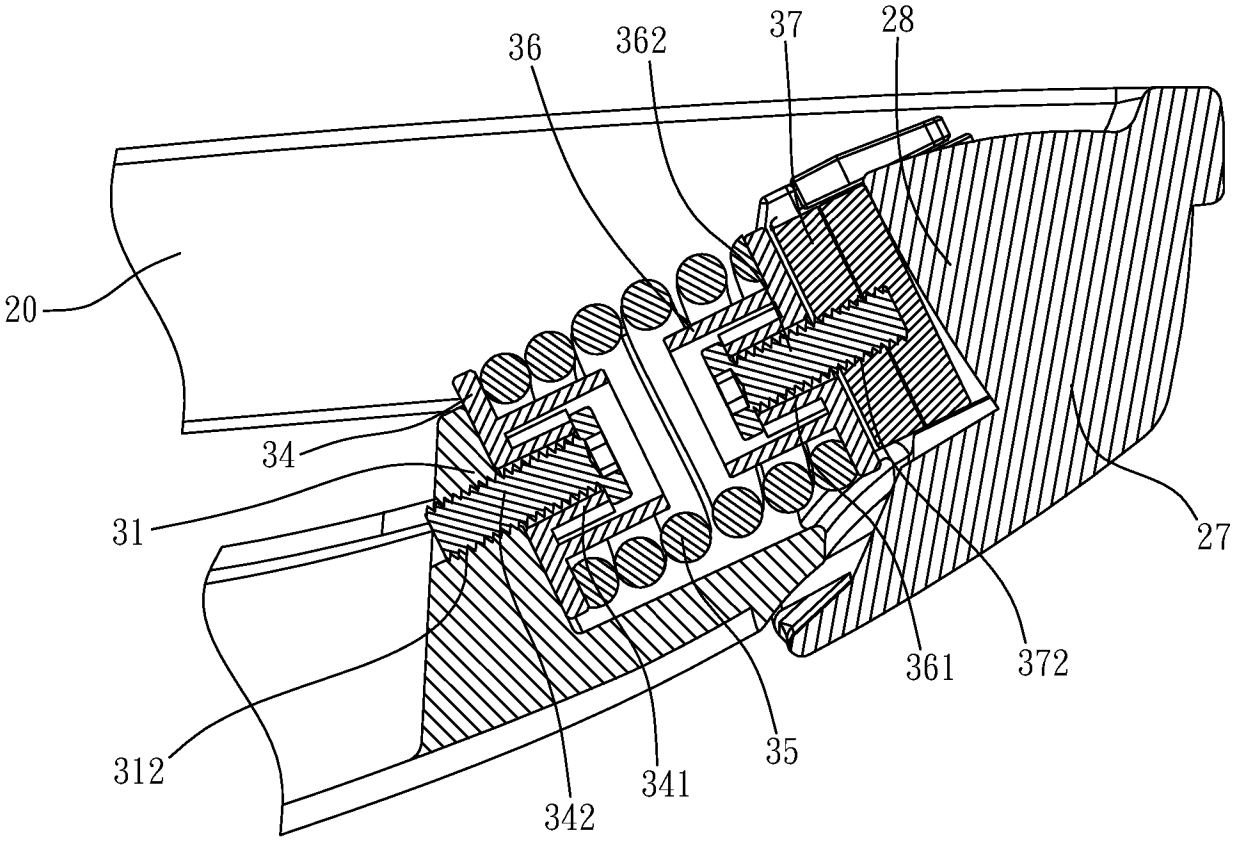
FIG. 9 is another cross sectional view showing the operation of the flexible support device for the chair back tilting according to the preferred embodiment of the present invention.

As shown in FIGS. 7-9, after the back portion 11 is forced to tilt, the supporting frame 10 drives the seating mounting 20 to slide on the base 30, the drive protrusion 28 of the seat mounting 20 presses the flexible sheet 37 to deform, and the flexible sheet 37 is supported by the spring 35. After the back portion 11 moves back to an original position, the spring 35 pushes the flexible sheet 37 to move back to an original position so that the seating mounting 20 moves back to an original position as well.

Thereby, the flexible support device is pressed by the drive protrusion 28 of the seat mounting 20 and the spring 35 to overcome a fatigue and noises of the spring 35. Also, the flexible sheet 37 is lightweight and produced at low cost.

While the first embodiments of the invention have been set forth for the purpose of disclosure, modifications of the disclosed embodiments of the invention as well as other embodiments thereof may occur to those skilled in the art. The scope of the claims should not be limited by the first embodiments set forth in the examples, but should be given the broadest interpretation consistent with the description as a whole.

What is claimed is:

1. A flexible support device for chair back tilting comprising:

a supporting frame including a back portion formed on a rear end of the supporting frame, two peripheral extensions extending from two sides of a bottom of the back portion, two rotatable tabs oppositely extending from the two peripheral extensions, two through orifices defined on the two rotatable tabs, two rotatable edges formed on two distal ends of the two peripheral extensions, two first coupling orifices defined on the two rotatable edges, and two second coupling orifices formed proximate to the two first coupling orifices;

a seat mounting including a first fixing portion and a second fixing portion opposite to the first fixing portion, two connecting fences connected with two sides of the first fixing portion and the second fixing portion, two rotatable locating portions formed on the two sides of the second fixing portion, two defining orifices defined on the two rotatable locating portions and corresponding to the two through orifices of the supporting frame, two joining elements configured to connect with the two through orifices of the supporting frame via the two defining orifices of the seat mounting, two slide orifices defined on two inner walls of the two connecting fences adjacent to the first fixing portion, and a drive protrusion extending to the second fixing portion from a center of an inner wall of the first fixing portion; and a base including two locating fringes with two first positioning orifices corresponding to the two first coupling orifices of the supporting frame, two second positioning orifices corresponding to the two second coupling orifices of the supporting frame, such that the two first coupling orifices and the two second coupling orifices of the supporting frame are connected with the two first positioning orifices and the two second positioning orifices by using two first screw bolts and two second screw bolts; the base further includes a holder extending from a center of a front end thereof and connected with a first end of a spring, and a second end of the spring being connected with a center of a first side of a flexible sheet;

wherein the flexible sheet has two peripheral sections formed on two sides thereof and accommodated in two receiving grooves of two connectors, the base further includes two connection segments corresponding to the two connectors, wherein the two connection segments have two openings, and the two connectors have two pegs extending therefrom and corresponding to the two openings so that the two pegs of the two connectors are connected with the two openings of the two connection segments, and the two peripheral sections of the flexible sheet are fixed on the two connection segments, thus fixing the flexible sheet;

wherein the two connection segments have two shafts extending from two outer walls thereof and slidably received in the two slide orifices of the seat mounting, and a center of a second side of the flexible sheet opposite to the spring is biased against the drive protrusion of the seat mounting.

2. The flexible support device as claimed in claim 1, wherein the flexible sheet is made of plastic or carbon fiber.

3. The flexible support device as claimed in claim 1, wherein the two connectors have two stop fringes extending from two sides thereof.

4. The flexible support device as claimed in claim 1, wherein the two second coupling orifices of the supporting frame are elongated.

5. The flexible support device as claimed in claim 1, wherein the two shafts of the base have two sheathes with two apertures fitted on the two shafts.

6. The flexible support device as claimed in claim 1, wherein the first end of the spring is fitted with a first fitting sleeve, and the second end of the spring is fitted with a second fitting sleeve, wherein the first fitting sleeve has a first passing orifice defined on a center thereof, and the holder has a second passing orifice corresponding to the first passing orifice, such that the second passing orifice and the first passing orifice are connected with a first threaded post to support the first end of the spring to connect with the holder of the base; the second fitting sleeve has a third passing orifice defined on a center thereof, and the flexible sheet has a screw portion corresponding to the third passing orifice, such that the screw portion and the second passing orifice are connected with a second threaded post to support the second end of the spring to connect with the center of the flexible sheet.

* * * * *